US009066607B1

(12) United States Patent
Ransil et al.

(10) Patent No.: US 9,066,607 B1
(45) Date of Patent: Jun. 30, 2015

(54) COLLAPSIBLE ACCESSORY PLATFORM FOR A CHILD'S PLAYARD

(71) Applicant: ARTSANA USA, INC., Lancaster, PA (US)

(72) Inventors: Matthew J. Ransil, Richland, PA (US); Michael L. Longenecker, Lancaster, PA (US)

( * ) Notice: Subject to any disclaimer, the term of this patent is extended or adjusted under 35 U.S.C. 154(b) by 18 days.

(21) Appl. No.: 13/958,728

(22) Filed: Aug. 5, 2013

Related U.S. Application Data

(60) Provisional application No. 61/680,040, filed on Aug. 6, 2012.

(51) Int. Cl.
*A47D 15/00* (2006.01)

(52) U.S. Cl.
CPC ..... *A47D 15/00* (2013.01)

(58) Field of Classification Search
CPC ..... A47D 7/002; A47D 7/005; A47D 7/04; A47D 9/00; A47D 9/005; A47D 15/00; A47D 15/008
USPC ..... 5/93.1–103, 120
See application file for complete search history.

(56) References Cited

U.S. PATENT DOCUMENTS

| | | | |
|---|---|---|---|
| 5,918,329 | A | 7/1999 | Huang |
| 6,526,608 | B1 | 3/2003 | Hsia |
| 6,543,070 | B2 | 4/2003 | Longenecker et al. |
| 6,701,547 | B2 | 3/2004 | Hsia |
| 7,263,729 | B2 | 9/2007 | Paesang et al. |
| 7,908,686 | B2 | 3/2011 | Clapper et al. |
| 2010/0017959 | A1 | 1/2010 | Yoshe et al. |
| 2012/0037869 | A1 | 2/2012 | Fiore, III et al. |
| 2012/0233770 | A1 | 9/2012 | Greger et al. |
| 2012/0235103 | A1 | 9/2012 | Greger et al. |

*Primary Examiner* — Peter M Cuomo
*Assistant Examiner* — Brittany Wilson
(74) *Attorney, Agent, or Firm* — Andrew D. Mead

(57) ABSTRACT

A foldable frame for supporting a bassinet for fitment on a child's playard comprising a pair of longitudinally extending upper frame rails connected at each end to a one of pair of transversely extending end members for pivotal movement about the transverse axis. A longitudinally extending lower frame rail is connected at each end to the respective end members and spaced apart from the upper frame rails. The length of the lower frame may be adjusted enabling the end members to pivot inwardly from an unfolded position toward a folded position and reduce the spacing between the upper and lower frame rails. The upper frame rails further include a wing pivot at each end member connection which are aligned to allow the upper frame rails to pivot about a longitudinal axis and reduce the frame width when the frame is folded, but do not allow pivoting when the frame is unfolded.

20 Claims, 10 Drawing Sheets

COLLAPSIBLE ACCESSORY PLATFORM FOR A CHILD'S PLAYARD

CROSS-REFERENCE TO RELATED APPLICATIONS

This application claims the benefit of priority of U.S. Provisional Application 61/680,040, filed Aug. 6, 2012.

BACKGROUND OF THE INVENTION

This invention relates generally to attachable accessories for a child's playard enclosure, and more particularly to a frame for supporting a changing table platform and the like that is collapsible when not in use into a compact space.

Playards are useful to contain and provide a safe environment for small children to sleep or play. Playards generally include side walls and a bottom floor made of fabric material or similar soft goods supported on a collapsible frame that allows the playard to be easily stored or transported.

As playards have become more popular with consumers, numerous related accessories have been developed to expand the capability and versatility of the playard. Bassinets, changing tables and the like may be selectively attached to the playard frame to provide an elevated surface for supporting infants in a more readily accessible position that eliminates the need for caregivers to bend over to access an infant on the playard floor.

Collapsible playard frames are well-known in the art. The proliferation of playard accessories has diminished the portability of the typical collapsible playard. Many playard accessories do not currently feature collapsible frames which pose reduces stowable compactness and creates problems for users requiring portability. Consequently, the need to provide collapsible accessory frames having the same level portability and compactness as the playard frame is a growing concern. Many benefits would be realized by an accessory frame for a playard that is conveniently collapsible into a compact form yet deployable into a configuration that is securely connectable to a playard without concern for unintentional detachment of the accessory frame and potential injury of an infant.

SUMMARY OF THE INVENTION

Accordingly, the present invention, in any of the embodiments described herein, may provide one or more of the following advantages:

It is an object of the present invention to provide a foldable frame for selective attachment to an upper frame rail of a child's playard. The playard frame comprises a plurality of upstanding frame members defining the corners of the playard. A plurality of horizontal frame members individually span between adjacent upstanding frame members to define a top perimeter frame which includes a pair of generally opposing, parallel, and spaced-apart side frame members and a pair of generally opposing end members interconnecting the side frame members. A plurality of generally planar wall panels span between adjacent upstanding frame members to define the side walls of the playard. The foldable frame comprises a pair of upper frame rails, a lower frame rail, and a pair of end members which join the upper and lower frame rails to form a frame. The end members are spaced-apart to define a longitudinal axis of the frame. The upper and lower frame rails extend generally parallel to the longitudinal axis to define a frame length and pivotally connected at each end to the end members to enable pivoting of the frame rails about transverse axes generally perpendicular to the longitudinal axis.

The upper frame rails have a fixed length between the pivoting connections. The lower frame rails incorporate telescoping sections enabling the length between the pivoting connections to be varied. The ability to shorten the lower frame rails length allows the end members to pivot inwardly toward the upper frame rails and the lower frame rails are moved toward the upper frame rails.

It is another object of the present invention to provide a foldable frame for selective attachment to an upper frame rail of a child's playard that is foldable about at least two axes wherein a first is generally transverse to the longitudinal axis of the frame and a second is generally parallel to the longitudinal axis. The foldable frame comprises a pair of upper frame rails, a lower frame rail, and a pair of end members which join the upper and lower frame rails to form a frame. The end members are spaced-apart to define a longitudinal axis of the frame. The upper and lower frame rails extend generally parallel to the longitudinal axis to define a frame length and pivotally connected at each end to the end members to enable pivoting of the frame rails about transverse axes generally perpendicular to the longitudinal axis. The upper frame rails have a fixed length between the pivoting connections. The lower frame rails incorporate telescoping sections enabling the length between the pivoting connections to be varied, allowing the end members to pivot inwardly toward the upper frame rails and the lower frame rails are moved toward the upper frame rails. The end members further include a second hinge connection adjacent each upper frame rail pivot connection that enables folding of the upper frame rails about an axis generally parallel to the longitudinal axis, but only when the end members have been pivoted to a collapsed position thereby co-linearly aligning the second hinge connection axes on the opposing ends of each upper frame rail.

Still another object of the present invention is to provide a foldable frame for selective attachment to an upper frame rail of a child's playard that provides a convenient platform for a various playard accessories. The foldable frame comprises a pair of upper frame rails, a lower frame rail, and a pair of end members which join the upper and lower frame rails to form the frame. Soft materials spanning between adjacent upper and lower support frame rails define the side walls and continues across the lower frame to define a bottom floor of the accessory for the playard. A removable or collapsible rigid panel spanning the lower frame supports provides a stable bottom for the accessory. One embodiment is commonly referred to as a changing table or changing platform. An alternate embodiment having additional depth (increased separation between upper and lower frame rails when deployed) could find utility to support an infant for a nap or as a convenient platform for storing diapers and the like.

It is a still further object of the present invention to provide a foldable accessory frame for selective attachment to an upper frame rail of a child's a playard capable of collapsing by folding about at least two axes, a first being generally transverse to the length of the accessory frame and a second being generally parallel to the length of the accessory frame. Movement about the first axis aligns pivots of the second axis to allow the pivoting about the second axis in a first pivotal position and inhibit pivoting about the second axis when not in the first pivotal position.

It is a still further object of the present invention to provide a foldable accessory frame capable of collapsing by folding about at least two axes that is durable in construction, inexpensive of manufacture, carefree of maintenance, easily assembled, and simple and effective to use.

These and other objects are achieved in accordance with the present invention by providing a foldable frame for supporting a bassinet for fitment on a child's playard comprising a pair of longitudinally extending upper frame rails connected at each end to a one of pair of transversely extending end members for pivotal movement about the transverse axis. A longitudinally extending lower frame rail is connected at each end to the respective end members and spaced apart from the upper frame rails. The length of the lower frame may be adjusted enabling the end members to pivot inwardly from an unfolded position toward a folded position and reduce the spacing between the upper and lower frame rails. The end members further include a wing pivot at each lateral side which are aligned to allow the upper and/or lower frame rails to pivot about a longitudinal axis and reduce the frame width when the frame is folded, but do not allow pivoting when the frame is unfolded.

BRIEF DESCRIPTION OF THE DRAWINGS

The advantages of this invention will be apparent upon consideration of the following detailed disclosure of the invention, especially when taken in conjunction with the accompanying drawings wherein.

DESCRIPTION OF THE PREFERRED EMBODIMENT(S)

Many of the fastening, connection, processes and other means and components utilized in this invention are widely known and used in the field of the invention described, and their exact nature or type is not necessary for an understanding and use of the invention by a person skilled in the art, and they will not therefore be discussed in significant detail. Also, any reference herein to the terms "up" or "down," or "top" or "bottom" are used as a matter of mere convenience, and are determined as the playard would normally rest on the floor or a similarly level surface. Furthermore, the various components shown or described herein for any specific application of this invention can be varied or altered as anticipated by this invention and the practice of a specific application of any element may already be widely known or used in the art by persons skilled in the art and each will likewise not therefore be discussed in significant detail. When referring to the figures, like parts are numbered the same in all of the figures.

Figure 1:
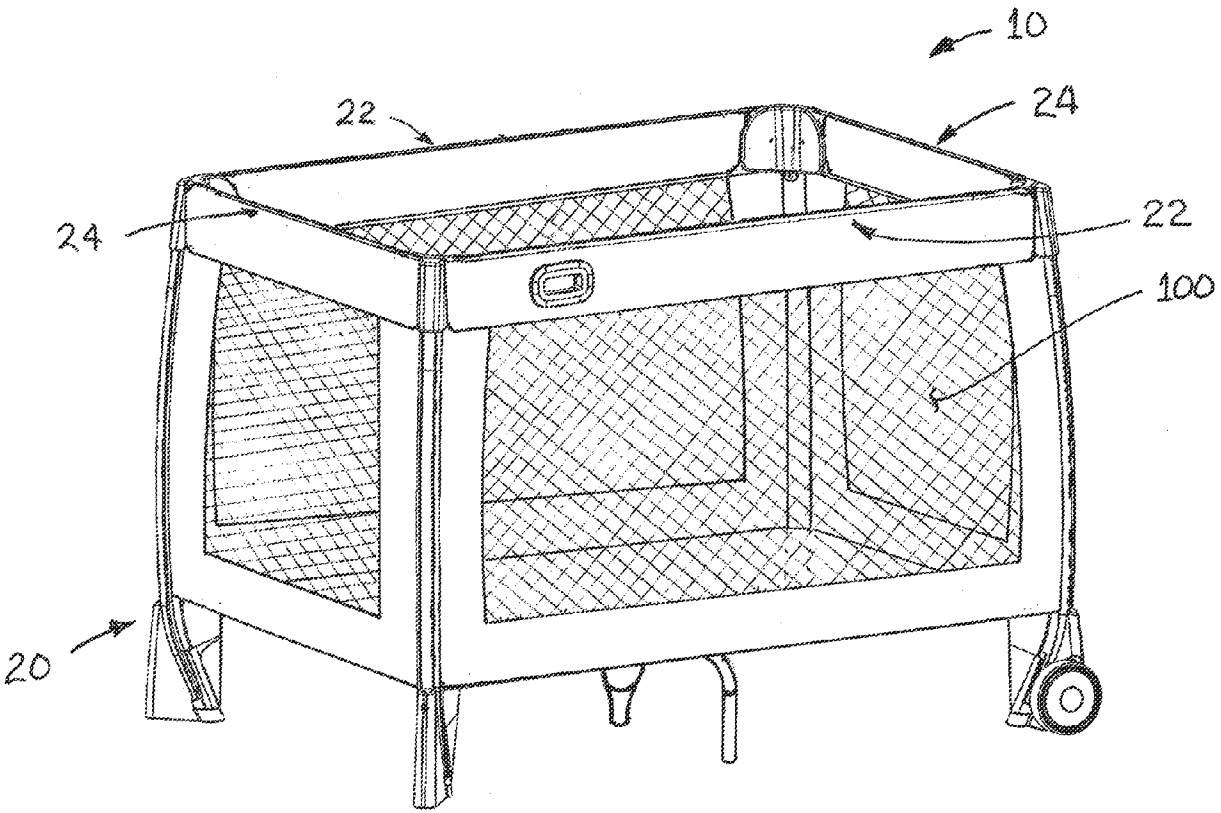
FIG. 1 is a perspective view of a conventional playard on which the present invention is useful.

Referring to the figures, an exemplary playard 10 on which the principles of the present invention are beneficial is shown in FIG. 1 comprising an upstanding frame structure 20 covered by a fabric body 100 defining side walls and a floor to contain a small child while leaving the area within the upper perimeter of the frame open. The frame structure 20 includes a pair of generally opposing and spaced-apart upper side rails 22 and a pair of generally opposing upper end rails 24 disposed between the opposing side rail members to form a generally rectangular upper perimeter of the playard frame structure 20. It is well known, though not shown in detail, to include movable joints and folding connections in the frame structure 20 that allow the playard to be collapsed for portability. Portable playards in the style of the exemplar presented are well known in the art and not discussed in further detail herein. Numerous playard accessories to enhance convenience for the caregiver are configured for attachment adjacent the upper perimeter frame.

Referring to FIGS. 2 through 7, a foldable accessory frame 30 for selective attachment to the exemplar playard is illustrated in an unfolded or deployed position as it would be configured for use on a playard. The accessory frame 30 may find utility in a variety of playard accessories. The exemplar accessory frame 30 shown herein is a configuration commonly referred to as a changing table which provides an elevated level surface encircled by an upstanding wall to provide a convenient area for attending to an infant. For purposes of clarity, the accessory frame 30 is shown with soft goods removed to better illustrate the relationship and degrees of motion of the frame members and related components.

The foldable accessory frame 30 comprises elongate first and second upper frame rails 32, 33 extending generally parallel to and spaced apart from a longitudinal axis 200 of the accessory frame. The ends of the upper frame rails 32, 33 are connected to first and second end members 35, 36 in a manner that allows pivotal movement therebetween about first and second upper pivot axes 201, 202 that are aligned transversely to longitudinal axis 200. The first and second upper frame rails 32, 33 and first and second ends 35, 36 are configured to define an upper perimeter of the accessory frame 30, preferably generally rectangular, with the frame members and end members defining the length, width, and a plane of the upper frame. It is preferable for the length and width dimensions to be fixed when the accessory frame is deployed for use.

The foldable frame 30 further comprises first and second lower frame rails 37, 38 which extend longitudinally generally parallel to the upper frame rails 32, 33. The lower frame rails 37, 38 are vertically spaced below the upper frame rails to define a frame depth and a lower perimeter which allows upstanding side walls to be formed by soft good panels spanning between the respective lower and upper frame perimeters. First and second lower frame rails 37, 38 are pivotally connected to the first and second end members 35, 36 by pivot connectors 359, 369 along first and second lower pivotal axes 205, 206 aligned parallel to and positioned below first and second upper pivot axes 201, 202, respectively.

Figure 3:
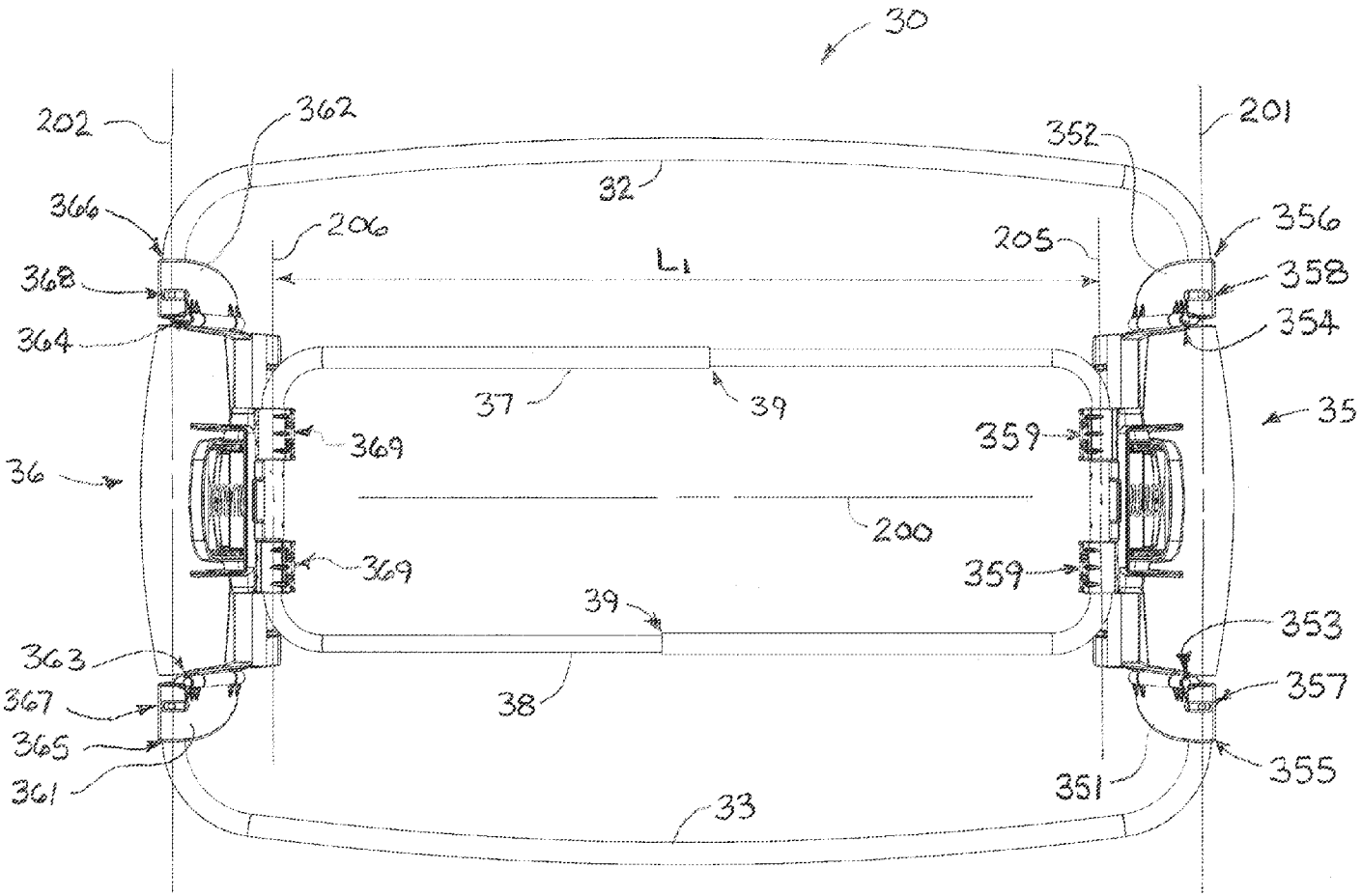
FIG. 3 is a plan view of an accessory frame of FIG. 2.
Figure 4:
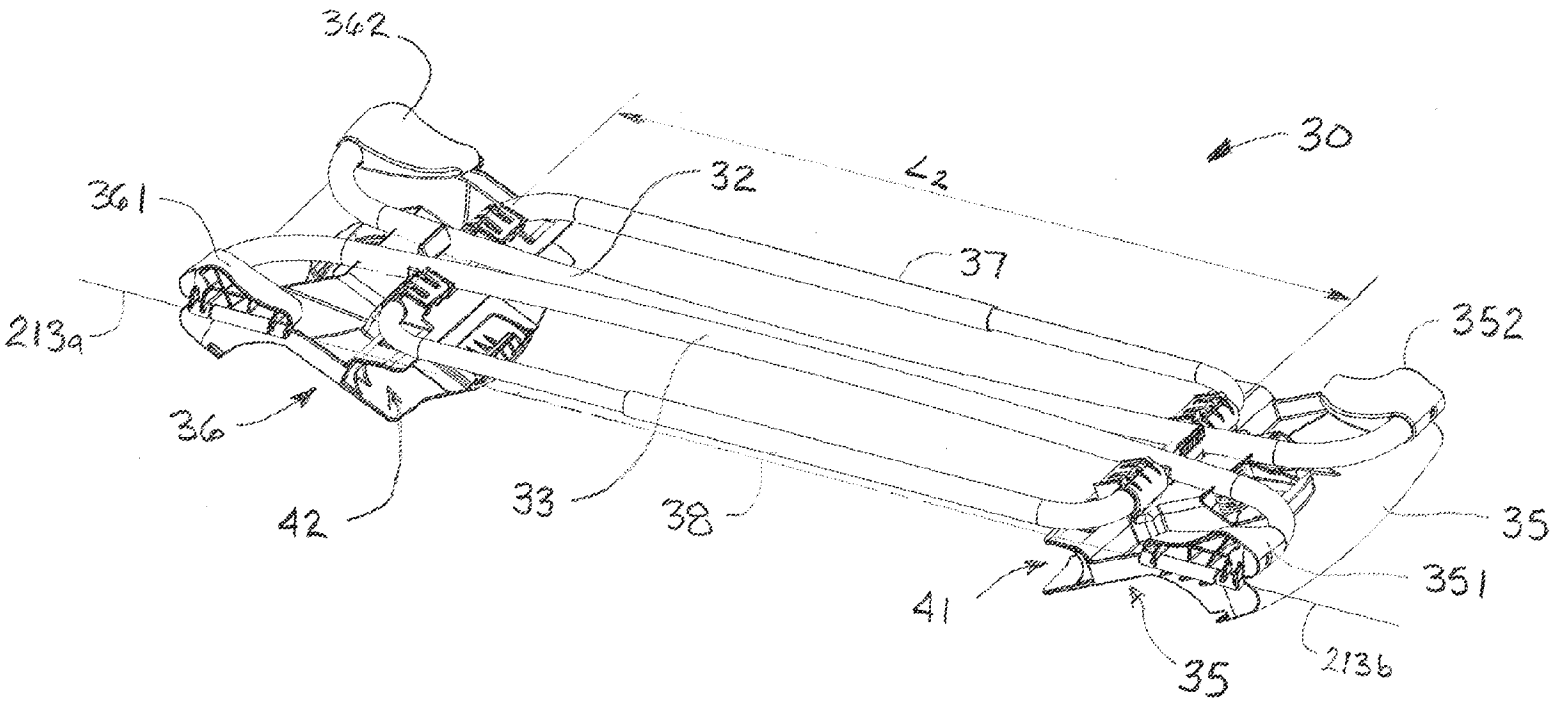
FIG. 4 is a perspective view of the accessory frame of FIG. 2 shown in a collapsed position as it would be for stowage.
Figure 5:
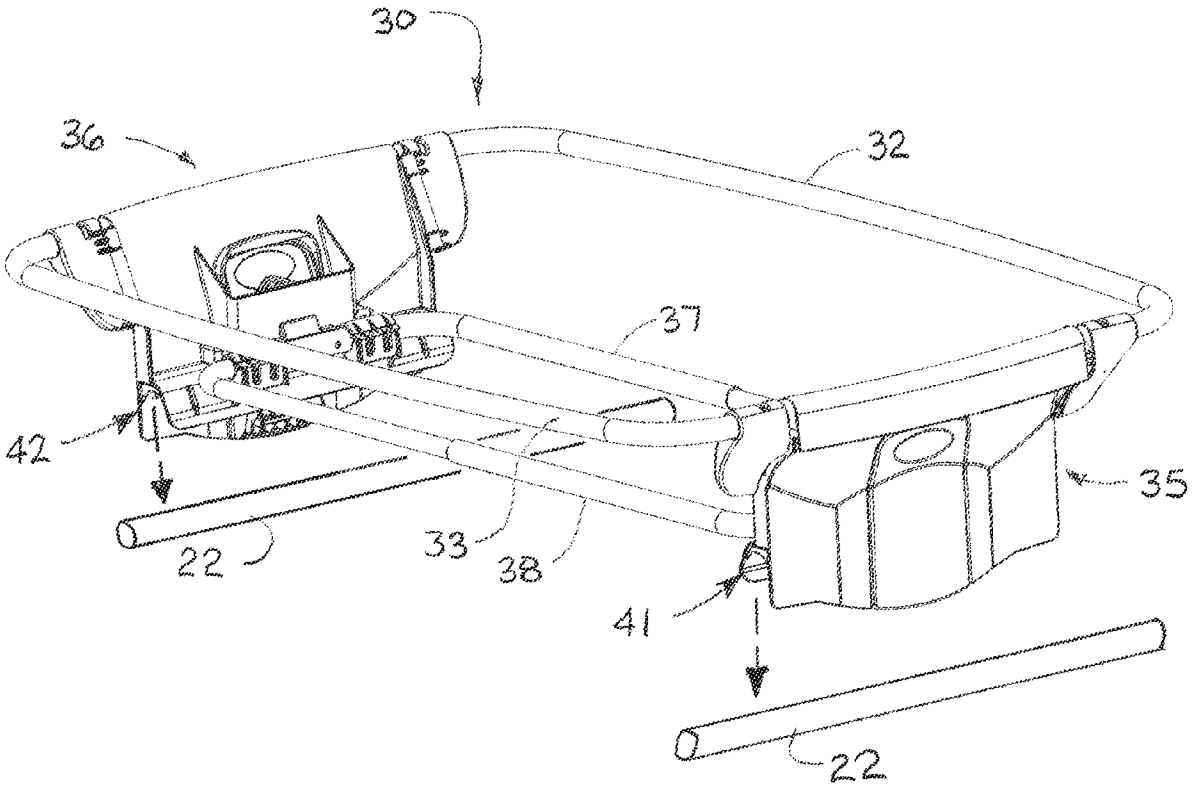
FIG. 5 is a perspective view of the accessory frame of FIG. 2 showing the connection to the playard upper frame members.
Figure 6:
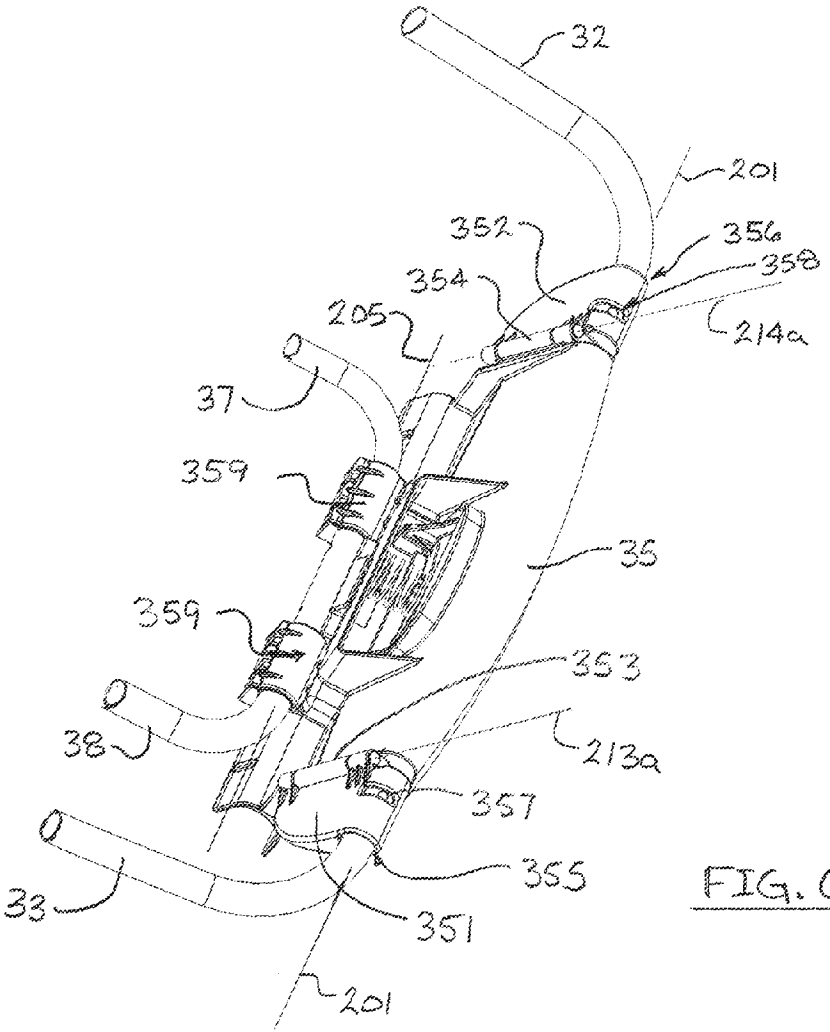
FIG. 6 is an expanded view on one end of the accessory frame of FIG. 2.
Figure 7:
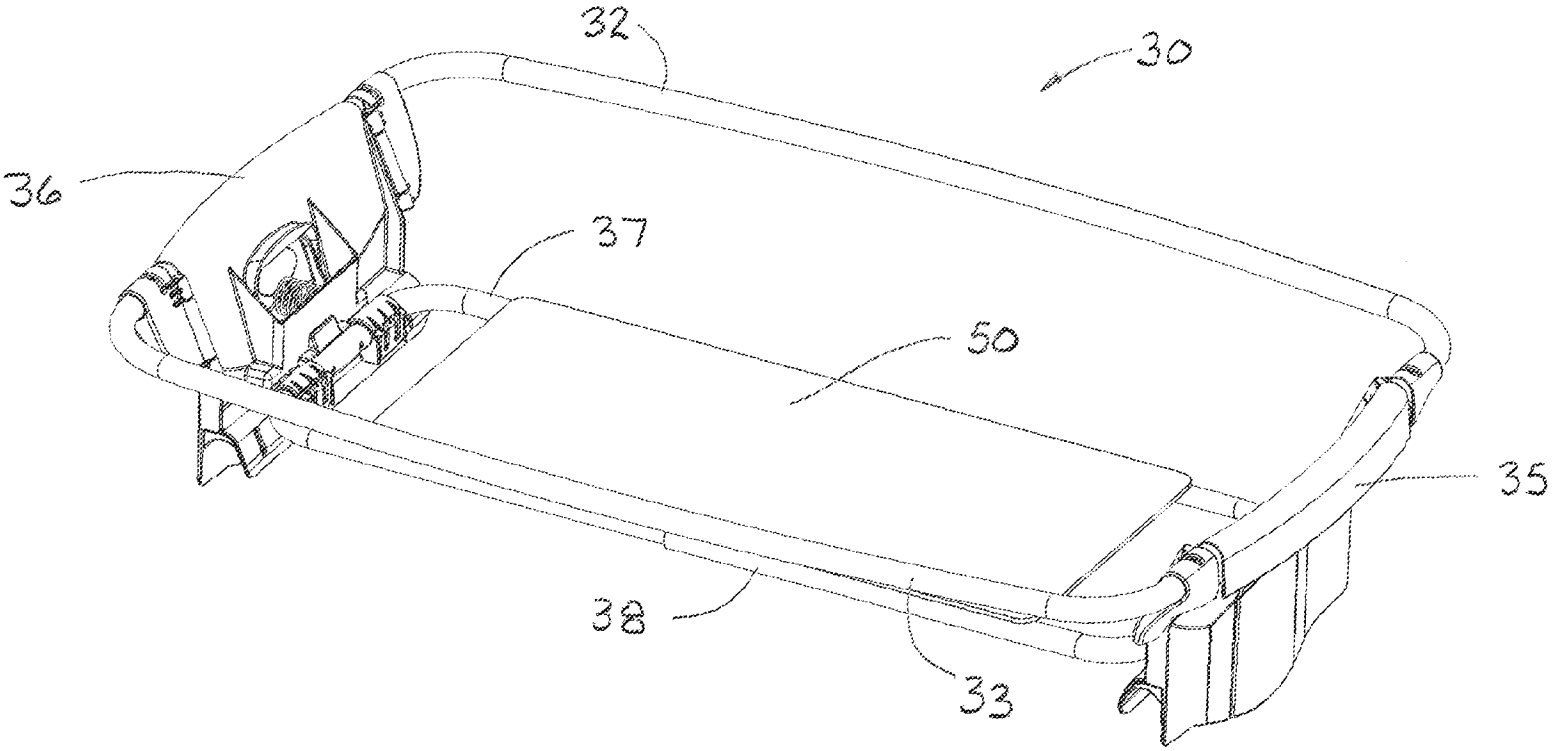
FIG. 7 is a perspective view of the accessory frame in the deployed position showing inclusion of a floor support panel.

First and second upper frame rails 32, 33 are preferably fixed in length. First and second lower frame rails 37, 38 each include telescoping joints 39 that allow the length of the lower frame rails to be varied. The variable length of the lower frame rails allows the first and second ends 35, 36 to be pivoted about first and second upper pivot axes 201, 202 so that the lower pivot connectors 359, 369 are moved inwardly toward the center of the frame and upwardly toward the plane of the upper frame perimeter. In so doing, the vertical height (depth) of the frame (separation between the upper and lower frame rails) is reduced and the lower frame rails 37, 38 are repositioned more closely to the plane of the upper frame rails as shown in FIG. 4. The accessory frame 30 is shown in a deployed position in FIG. 3 and the length of the lower frame rails is indicated as $L_1$. As shown in FIG. 4, the collapsed accessory frame 30 is accomplished by shortening the length of the lower frame rails 37, 38 to a collapsed length of $L_2$ which is less than $L_1$. Detents in the pivoting connections or latches may be provided to maintain the accessory frame 30 in the deployed position and prevent unintended collapse of the frame during use.

In one embodiment, the accessory frame 30 further comprises a support panel 50 disposed upwardly adjacent to the lower frame rails 37, 38 to provide a stable bottom or floor for the accessory frame. The support panel may be easily removable for stowage or, by limiting the length of the support panel to a length less than the collapsed length $L_2$ of the lower frame rails 37, 38, the support panel may remain in position as the accessory frame is collapsed.

The accessory frame 30 is further configured for placement atop the upper side rails 22 of the playard frame. One or more saddle-like receiver structures 41, 42 are provided on the lower edges of each of the first and second ends 35, 36 and aligned to engage the playard upper side rails when the foldable frame is operably installed atop the playard. The receiver structures 41, 42 are configured so that once the changing table is lowered onto the playard frame and the receiver structures 41, 42 engage the upper perimeter frame rails 22, the accessory frame is laterally restrained from movement in relation to the playard. See FIG. 5. Additional details on the connection apparatus for the accessory frame are disclosed in U.S. application Ser. No. 13/422,075, filed Mar. 16, 2012 and having common assignee to the present application, the entirety of which is incorporated herein by reference.

Figure 2:
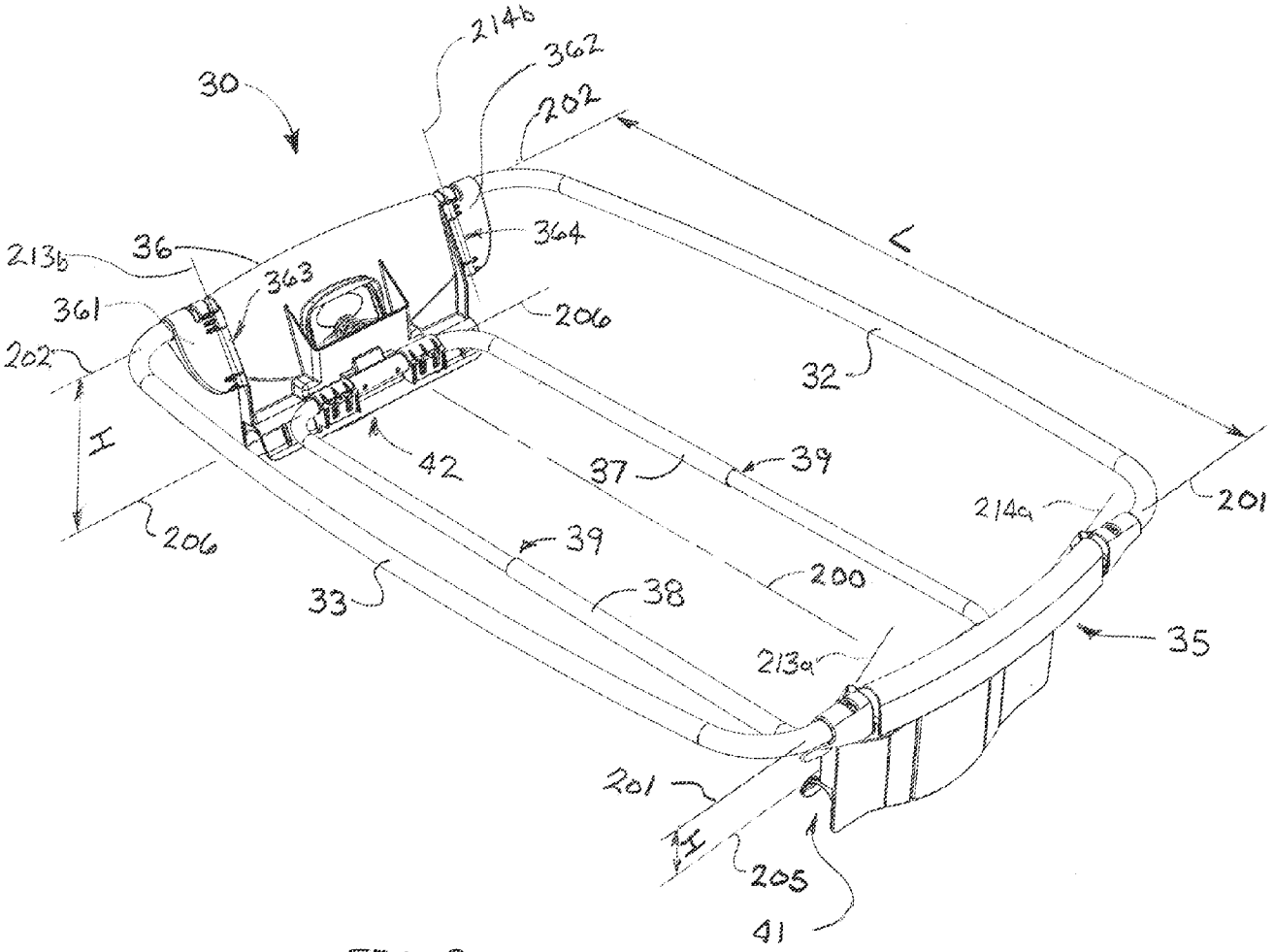
FIG. 2 is a perspective view of a foldable accessory frame shown deployed for use in which the soft goods have been removed embodying aspects of the present invention and useful with the playard of FIG. 1.

In addition to having a collapsible height as described above, the accessory frame 30 also includes features to allow the width of the frame to be reduced for stowage or convenience. First and second ends 35, 36 feature additional hinged connections 353, 354, 363, 364 for the upper frame rails which allow the upper frame rails to be folded inwardly toward the longitudinal centerline of the accessory frame once the initial pivoting of the end members to the stowed position (shown in FIG. 4) has occurred. To this end, first end member 35 further includes outboard wing members 351 and 352 which are pivotally connected to the end member 35 by wing hinges 353, 354 pivoting about wing pivot axes 213*a*, 214*a*, respectively. The outboard wing members 351, 352 incorporate the pivoting connections 355, 356 for upper frame rails 32, 33 allowing pivoting about first upper pivot axis 201. Second end member 36 is similarly configured comprising outboard wing members 361 and 362 which are pivotally connected to the end member 36 by pivoting connections 365, 366 at wing pivot axes 213*b*, 214*b*, respectively. Movement about the wing pivot axes 213, 214 is on the order of 180 degrees between the deployed position and the folded position. When the accessory frame is deployed for use, as shown in FIGS. 2 and 3, the opposing wing axis pairs 213*a*, 213*b* and 214*a*, 214*b* are skewed relative to the longitudinal centerline 200, and non-co-axially aligned which prevents folding of the wing members 351, 352, 361, 362. As the accessory frame is folded toward the stowed position, the opposing wing axis pairs align so that wing axis 213*a* is co-axially aligned with wing axis 213*b*, wing axis 213*b* is co-axially aligned with wing axis 214*b*, and all of the wing axes are parallel to the longitudinal axis 200. Once the wing axis pairs are aligned, the upper frame rails 32, 33 may be folded inwardly toward the accessory frame centerline as shown in FIG. 4 thereby reducing the width of the accessory frame for stowage. It is only when the respective wing axes are aligned that folding of the upper frame wings is possible thereby precluding unintentional collapse of the upper frame rails when the accessory frame is in a deployed position.

Outboard wing member pivoting connections 355, 356, 365, 366 further incorporate pivot limiters 357, 358, 367, 368, respectively, which limit the degree of upper frame rail 32, 33 motion, preferably to approximately 90 degrees corresponding to the necessary pivoting movement of the end members 35, 36 about pivot axes 201, 202. The pivot limiters 357, 358, 367, 368 further assure that the end members 35, 36 may not be pivoted when the end members are in the collapsed position (FIG. 4). By preventing end member pivoting when the wing members are folded inwardly, the mechanism establishes a sequence for collapsing and deploying the accessory frame and inhibits unintentional collapsing and deploying of the frame. Locking provisions such as detents or snap locks may also be incorporated to retain the pivoting connections 355, 356, 365, 366 in preferred positions corresponding to the collapsed and deployed positions to further in inhibit unintentional movement of the accessory frame whether collapsed for stowage or deployed for use.

Figure 8:
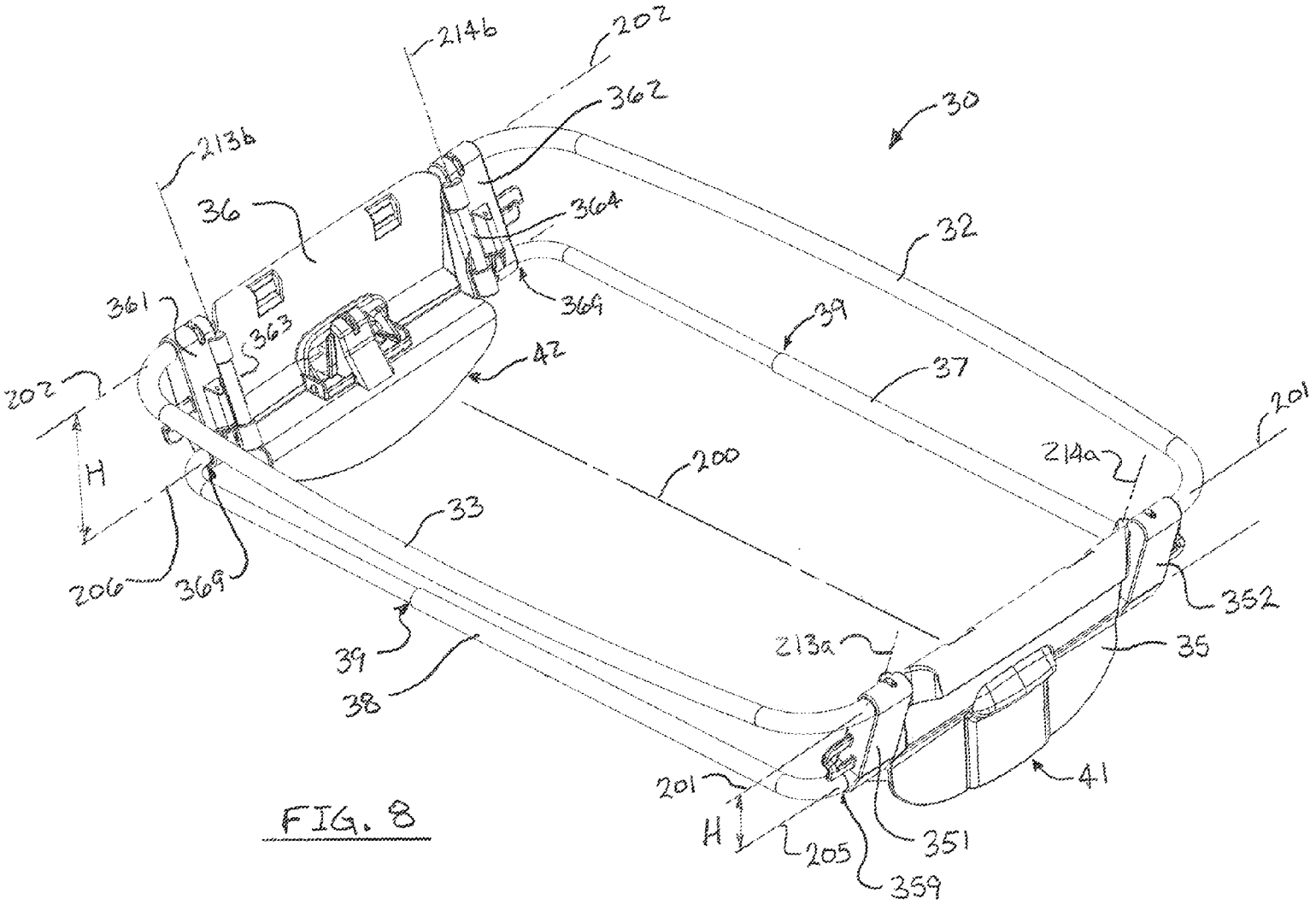
FIG. 8 is a perspective view of a second embodiment of the accessory frame shown in the deployed position.
Figure 9:
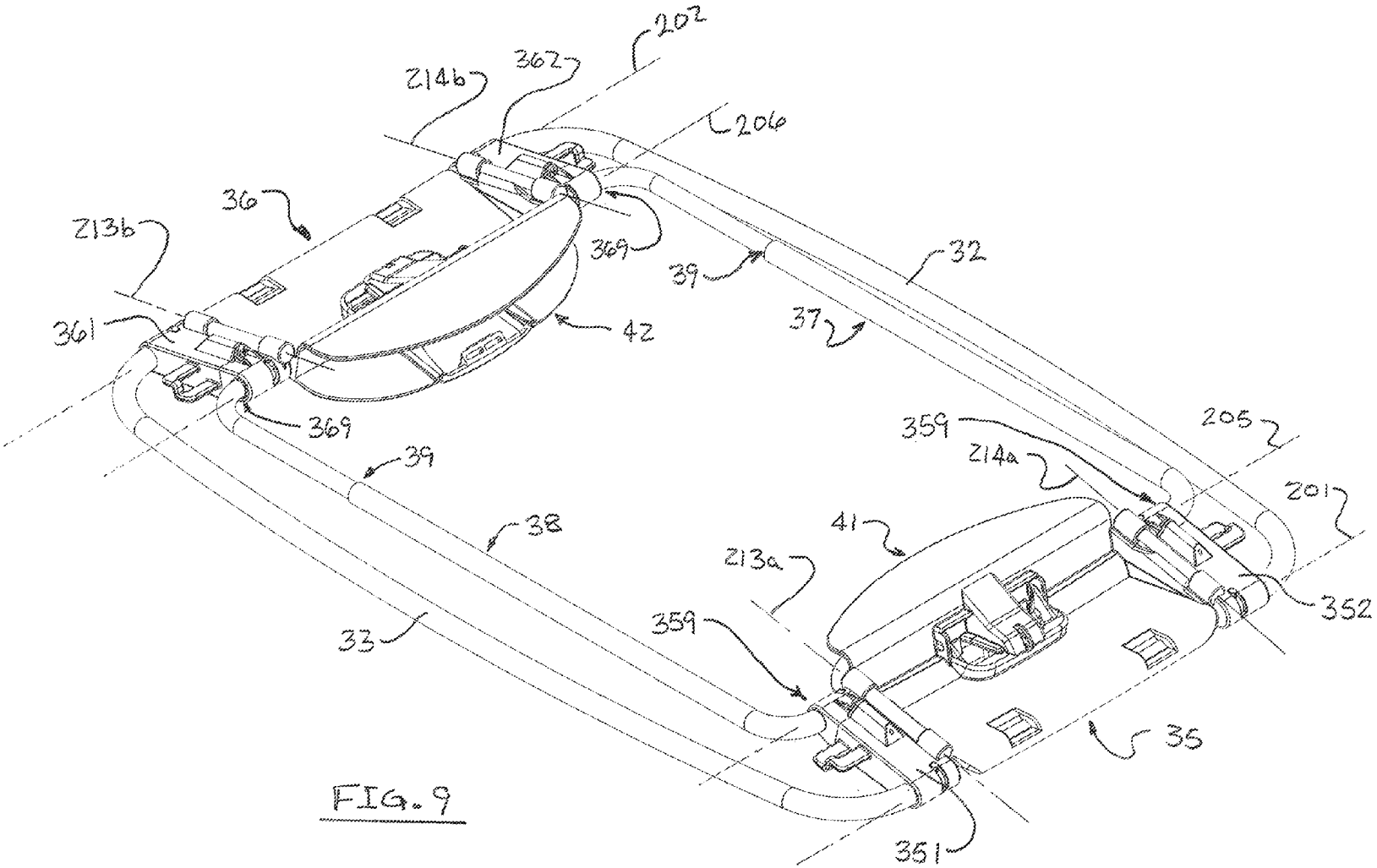
FIG. 9 is a perspective view of the accessory frame of FIG. 8 in which the end members have been pivoted to allow the frame to be vertically collapsed to its minimum height.
Figure 10:
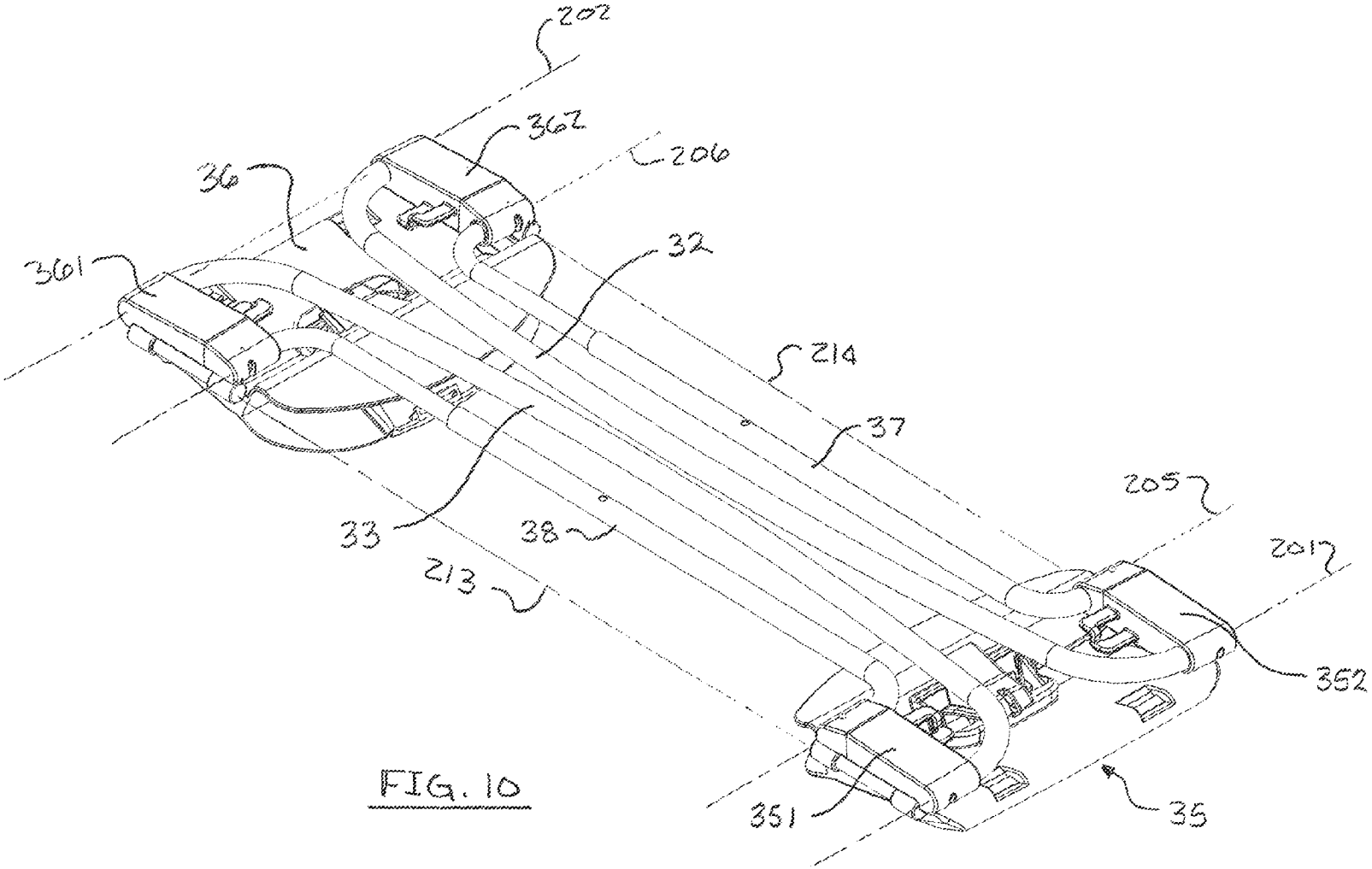
FIG. 10 is a perspective view of the accessory frame of FIG. 9 in which the wing members have been folded to allow the frame to be positioned to its minimum width.

FIGS. 8 through 10 illustrate a second embodiment of the accessory frame in which the lower frame rails 37, 38 are also rotatably connected to the outboard wing members 351, 352, 361, 362. In this embodiment, lower pivot connectors 359, 369 are relocated from the end members 35, 36 to respective outboard wing members 351, 352, 361, 362. This embodiment enables greater lateral spacing between the lower frame rails 37, 38 (wider than the width of the end members 35, 36) to improve stability of a floor panel (not shown), when installed without adversely affecting the minimum width that can be accomplished when the wing members are folded. Telescoping joints 39 are provided so that vertical collapse of the accessory frame 30 functions as previously described.

Naturally, the invention is not limited to the foregoing embodiments, but it can also be modified in many ways without departing from the basic concepts. Changes in the details, materials, steps and arrangements of parts which have been described and illustrated to explain the nature of the invention will occur to and may be made by those skilled in the art upon a reading of this disclosure within the principles and scope of the invention. The foregoing description illustrates the preferred embodiment of the invention; however, concepts, as based upon the description, may be employed in other embodiments without departing from the scope of the invention.

Having thus described the invention, what is claimed is:

1. An accessory frame for fitment on a child's playard, the frame being moveable between an unfolded position for use and a folded position for storage, the accessory frame comprising:

an upper frame having a pair of spaced-apart upper side rails extending generally parallel to a lengthwise axis between generally opposing ends;

a lower frame extending generally parallel to the lengthwise axis between generally opposing ends, the lower frame having a length that is adjustable between extended and retracted lengths; and first and second end members extending transverse to the lengthwise axis connecting the upper frame and the lower frame, one end member positioned at each respective opposing end of the upper side rails and the lower frame, the first and second end members and the upper frame defining a generally planar upper perimeter, the first and second end members positioning the lower frame in a lower plane generally parallel to and spaced apart from the plane of the upper perimeter, the end members each being pivotable in relation to the upper frame and the lower frame about respective upper and lower pivot axes to move the accessory frame between the folded and unfolded positions, the pivot axes being generally transverse to the lengthwise axis, the lower plane being spaced a first distance from the plane of the upper frame when the frame is in the unfolded position and a second distance from the plane of the upper frame when the frame is in the folded position, the second distance being less than the first distance.

2. The accessory frame of claim 1, wherein the lower frame comprises a pair of generally parallel, spaced apart telescoping members.

3. The accessory frame of claim 1, wherein the end members rotate in opposite directions when moving the accessory frame between the folded and unfolded positions.

4. The accessory frame of claim 3, wherein the end members further comprise stop mechanisms to limit rotational movement of each end member relative to the upper side rails to a range between the folded and the unfolded positions, inclusive.

5. The accessory frame of claim 4, wherein rotational movement of each end member relative to the upper side rails is limited to approximately 90 degrees.

6. The accessory frame of claim 1, wherein each upper side rail is attached to the respective end members by first and second wing connectors pivotally connected to the opposing end members, respectively, for movement about first and second wing axes, the first and second wing axes being generally perpendicularly oriented to the respective transverse axes of the end members, the first and second wing axes being angled relative to one another when the frame is in the unfolded position thereby preventing rotation of the upper side rails about the respective wing axes, the first and second wing axes being co-axially aligned when the frame is in the folded position thereby allowing the upper side rails to rotate about the respective wing axes and reduce accessory frame width.

7. The accessory frame of claim 6, wherein the wing connectors enable the upper side rails to move between opposing first and second positions when the frame is in the folded position, the first position maximizing the transverse space between the upper side rails and the second position minimizing the transverse spacing between the upper side rails.

8. The accessory frame of claim 7, wherein rotational movement of each upper side rail about the wing axes between the first position and the second position is approximately 180 degrees.

9. The accessory frame of claim 2, wherein each wherein each upper side rail and each lower telescoping member is attached the respective end members by first and second wing connectors pivotally connected to the opposing end members, respectively, for movement about first and second wing axes, the first and second wing axes being generally perpendicularly oriented to the respective transverse axes of the end members, the first and second wing axes being angled relative to one another when the frame is in the unfolded position thereby preventing rotation of the upper side rails and the lower telescoping members about the respective wing axes, the first and second wing axes being co-axially aligned when the frame is in the folded position thereby allowing the upper side rails and lower telescoping rails to rotate about the respective wing axes and reduce accessory frame width.

10. The accessory frame of claim 9, wherein the wing connectors enable the side and telescoping rails to move between opposing first and second positions when the frame is in the folded position, the first position maximizing the transverse space between the rails and the second position minimizing the transverse spacing between the rails.

11. A foldable accessory frame for fitment on a child's playard comprising:

an upper frame having a pair of spaced apart elongate upper side rails extending generally parallel to a lengthwise axis between generally opposing ends;

a lower frame extending generally parallel to the lengthwise axis between generally opposing ends, the lower frame being adjustable in length along the lengthwise axis between an extended length and a refracted length; and first and second end members extending transverse to the lengthwise axis connecting the upper frame and the lower frame, one end member positioned at each respective opposing end of the upper side rails and the lower frame, the first and second end members and the upper frame defining an upper perimeter plane, the first and second ene members positioning the lower frame in a lower plane generally spaced apart from and parallel to the upper perimeter plane, the end members each being pivotable in relation to the upper and lower frames about respective upper and lower pivot axes between folded and unfolded positions, the pivot axes being generally transverse to the lengthwise axis, the lower plane being spaced a first distance from the upper plane when the end members are in an unfolded position and the lower frame rail is in the extended position, movement of the lower frame toward the retracted position and pivoting of the end members toward the folded position moving the lower plane toward the upper perimeter plane.

12. The accessory frame of claim 11, wherein the lower frame comprises a pair of generally parallel, spaced apart telescoping members.

13. The accessory frame of claim 12, further comprising first and second wing connectors for attaching the ends of each upper side rail to the respective end members, the first and second wing connectors being pivotally connected to the end members for movement about first and second wing axes, the first and second wing axes being generally perpendicularly oriented to the pivot axes, the first and second wing axes being angled relative to one another when the end members are in the unfolded position and co-axially aligned when the first and second end members are in the folded position thereby allowing the upper side frame members to rotate about the respective wing axes of the opposing end members.

14. The accessory frame of claim 13, wherein the end members rotate in opposite directions when moving between the folded and unfolded positions.

15. The accessory frame of claim 14, wherein the end members further comprise stop mechanisms to limit rotational movement of each end member relative to the upper side rails to a range between the folded and the unfolded positions, inclusive.

16. The accessory frame of claim 15, wherein rotational movement of each end member relative to the upper side rails is limited to approximately 90 degrees.

17. The accessory frame of claim 16, wherein the first and second wing connectors enable the upper side frame members to be pivoted between an inboard and an outboard position when the first and second end members are in the folded position.

18. The accessory frame of claim 17, wherein rotational movement of each upper side rail about the wing axes between the inboard position and the outboard position is approximately 180 degrees.

19. The accessory frame of claim 13, wherein end of the telescoping lower frame members are pivotally connected to the first and second wing connectors, respectively, for rotation about generally transverse axes.

20. The accessory frame of claim 19, wherein the first and second wing connectors enable the upper side rails and the lower frame telescoping members to be pivoted between an inboard and an outboard position when the first and second end members are in the folded position.

* * * * *